US012222111B2

(12) United States Patent
Santana et al.

(10) Patent No.: US 12,222,111 B2
(45) Date of Patent: Feb. 11, 2025

(54) PREHEAT PROGRESS MONITORING FOR AN APPLIANCE

(71) Applicant: Haier US Appliance Solutions, Inc., Wilmington, DE (US)

(72) Inventors: Omar Santana, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 273 days.

(21) Appl. No.: 17/830,701

(22) Filed: Jun. 2, 2022

(65) Prior Publication Data

US 2023/0392797 A1 Dec. 7, 2023

(51) Int. Cl.
*F24C 7/08* (2006.01)
*F24C 3/12* (2006.01)

(52) U.S. Cl.
CPC ..... *F24C 7/087* (2013.01); *F24C 3/128* (2013.01); *F24C 7/085* (2013.01)

(58) Field of Classification Search
CPC ..... F24C 7/085; F24C 3/128; F24C 7/087
See application file for complete search history.

(56) References Cited

U.S. PATENT DOCUMENTS

| | | | | |
|---|---|---|---|---|
| 8,269,151 | B2 | 9/2012 | Klasmeier et al. | |
| 10,253,989 | B2 | 4/2019 | Helm et al. | |
| 2021/0145212 | A1* | 5/2021 | Wang | A47J 36/32 |

FOREIGN PATENT DOCUMENTS

| | | | | |
|---|---|---|---|---|
| CN | 111145284 | A | 5/2020 | |
| CN | 111145284 | B * | 12/2023 | A47J 27/004 |
| DE | 4231365 | A1 | 3/1994 | |
| DE | 102007040316 | A1 | 2/2009 | |
| JP | 4271058 | B2 | 6/2009 | |
| JP | 5425259 | B2 | 2/2014 | |
| KR | 19990010214 | U | 3/1999 | |

* cited by examiner

*Primary Examiner* — Thien S Tran
(74) *Attorney, Agent, or Firm* — Dority & Manning, P.A.

(57) ABSTRACT

A method for monitoring progress of a preheat cycle includes: at a start of a preheat cycle, receiving a baseline temperature measurement from a sensor; during the preheat cycle, receiving a plurality of current temperature measurements from the sensor; repeatedly calculating a progress indicator value for the preheat cycle from a baseline progress indicator value; and when a latest one of the plurality of current temperature measurements is less than an immediate prior one of the plurality of current temperature measurements, setting the baseline temperature measurement to the latest one of the plurality of current temperature measurements and setting the baseline progress indicator value to an immediate prior progress indicator value.

12 Claims, 6 Drawing Sheets

PREHEAT PROGRESS MONITORING FOR AN APPLIANCE

FIELD OF THE INVENTION

The present subject matter relates generally to appliances and, more particularly, to preheat progress monitoring in appliances.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and/or a separate broiler heating assembly positioned at a top of the cooking chamber.

Conventional residential and commercial cooktop appliances can also include multiple gas or electric heating elements for heating utensils to cook food items located therein. With closed-loop control, a temperature sensor can measure a temperature of the utensil, food, etc., and operation of the heating elements can be controlled based upon the temperature measurements from the sensor.

Prior to cooking a food item, a cooking temperature may be selected, and the heating elements may operate to heat the cooking chamber/utensil to the selected cooking temperature during a preheating cycle, which precedes the subsequent cooking cycle. A status of the preheating cycle may be displayed during the preheating cycle. For instance, certain oven and cooktop appliances present a current temperature of the cooking chamber, and an alert is activated when the preheat cycle is complete and the cooking chamber/utensil is at the selected cooking temperature.

The temperature of the cooking chamber/utensil can decrease during the preheating cycle for a variety of reasons. For example, a user can open a door of the cooking chamber, or the user can add water to the utensil. The displayed status of the preheating cycle may reflect the temperature drop, e.g., such that the displayed current temperature of the cooking chamber/utensil decreases or remains fixed at the current temperature prior to the drop. Certain users negatively interpret such changes in the displayed status of the preheating cycle as indicating that the preheat was cancelled or paused.

BRIEF DESCRIPTION OF THE INVENTION

Aspects and advantages of the invention will be set forth in part in the following description, or may be apparent from the description, or may be learned through practice of the invention.

In an example embodiment, a method for monitoring progress of a preheat cycle includes: at a start of a preheat cycle, receiving a baseline temperature measurement from a sensor; during the preheat cycle, receiving a plurality of current temperature measurements from the sensor; repeatedly calculating a progress indicator value for the preheat cycle from a baseline progress indicator value based at least in part on a difference between a latest one of the plurality of current temperature measurements and the baseline temperature measurement and a difference between a set temperature for the preheat cycle and the baseline temperature measurement; and, when the latest one of the plurality of current temperature measurements is less than an immediate prior one of the plurality of current temperature measurements, setting the baseline temperature measurement to the latest one of the plurality of current temperature measurements and setting the baseline progress indicator value to an immediate prior progress indicator value.

In another example embodiment, a method for monitoring progress of a preheat cycle includes: at a start of a preheat cycle, receiving a baseline temperature measurement from a sensor; during the preheat cycle, receiving a plurality of current temperature measurements from the sensor; repeatedly calculating a percent progress of the preheat cycle from a baseline percent progress with the following $$\%\ \text{Progress}_C = \%\ \text{Progress}_B + (100\% - \%\ \text{Progress}_B) * \frac{(T_C - T_B)}{(T_S - T_B)},$$

wherein % $\text{Progress}_C$ is a current percent progress of the preheat cycle, % $\text{Progress}_B$ is the baseline percent progress, $T_C$ is the current temperature measurement, $T_S$ is the set temperature for the preheat cycle, and $T_B$ is the baseline temperature measurement; and, when the latest one of the plurality of current temperature measurements is less than an immediate prior one of the plurality of current temperature measurements, setting the baseline temperature measurement to the latest one of the plurality of current temperature measurements and setting the baseline percent progress to an immediate prior percent progress.

In another example embodiment, a method for monitoring progress of a preheat cycle includes: at a start of a preheat cycle, receiving a baseline temperature measurement from a sensor; during the preheat cycle, receiving a plurality of current temperature measurements from the sensor; repeatedly calculating a display temperature for the preheat cycle from a baseline display temperature with the following $$T_{DC} = T_{DB} + (T_S - T_{DB}) * \frac{(T_C - T_B)}{(T_S - T_B)},$$

wherein $T_{DC}$ is a current display temperature for the preheat cycle, $T_{DB}$ is the baseline display temperature for the preheat cycle, $T_S$ is the set temperature for the preheat cycle, $T_C$ is the current temperature measurement, and $T_B$ is the baseline temperature measurement; and, when the latest one of the plurality of current temperature measurements is less than an immediate prior one of the plurality of current temperature measurements, setting the baseline temperature measurement to the latest one of the plurality of current temperature measurements and setting the baseline display temperature to an immediate prior display temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
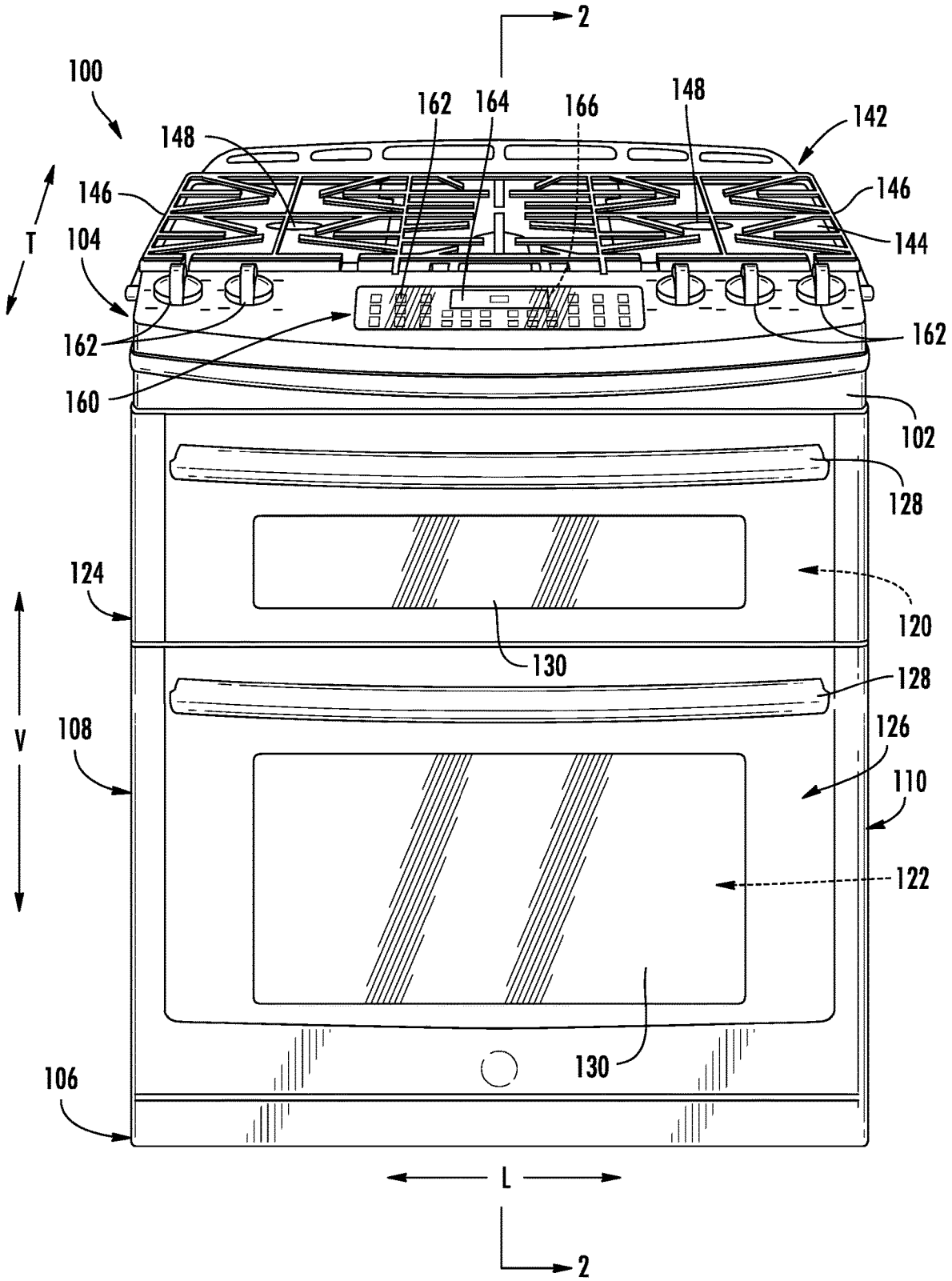
FIG. 1 is a front, perspective view of an oven appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is an upper cooking chamber 120 and a lower cooking chamber 122 configured for the receipt of one or more food items to be cooked. Thus, oven appliance 100 is generally referred to as a double oven range appliance. However, as will be understood by those skilled in the art, oven appliance 100 is provided by way of example only, and the present subject matter may be used in any suitable cooking appliance. Thus, the present subject matter may be used with other cooking appliances, such as standalone cooktops, wall ovens, electric ovens, gas ovens, microwave ovens, etc. In addition, the example embodiment shown in FIG. 1 is not intended to limit the present subject matter to any particular cooking chamber configuration or arrangement.

Oven appliance 100 includes an upper door 124 and a lower door 126 rotatably attached to cabinet 102 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Doors 124, 126 may include windows 130, constructed for example from multiple parallel glass panes to provide for viewing the contents of and insulating the insulated cooking chambers 120, 122.

As illustrated, each of insulated cooking chambers 120, 122 are defined by a plurality of chamber walls, identified generally herein by reference numeral 132. For example, insulated cooking chambers 120, 122 each include a top wall 134 and a bottom wall 136 which are spaced apart along the vertical direction V. A left sidewall and a right sidewall extend between the top wall 134 and bottom wall 136, and are spaced apart along the lateral direction L. A rear wall 138 may additionally extend between the top wall 134 and the bottom wall 136 as well as between the left sidewall and the right sidewall, and is spaced apart from doors 124, 126 along the transverse direction T. In this manner, when doors 124, 126 are in the closed position, cooking cavities are defined, and a front opening 140 is defined for each cooking chamber 120, 122, e.g., proximate front 112 of oven appliance 100.

Referring to FIG. 1, oven appliance 100 also includes a cooktop 142. Cooktop 142 is positioned at or adjacent top 104 of cabinet 102. Thus, cooktop 142 is positioned above upper cooking chamber 120 and includes a top panel 144 positioned proximate top 104 of cabinet 102. By way of example, top panel 144 may be constructed of glass, ceramics, enameled steel, and combinations thereof. One or more grates 146 are supported on a top surface of top panel 144 for supporting cooking utensils, such as pots or pans, during a cooking process. As shown in FIG. 1, oven appliance 100 may include a plurality of burners 148 mounted within or on top of top panel 144 underneath grates 146, and such burner 148 can be configured in various sizes so as to provide e.g., for the receipt of cooking utensils (i.e., pots, pans, etc.) of various sizes and configurations and to provide different heat inputs for such cooking utensils.

Figure 2:
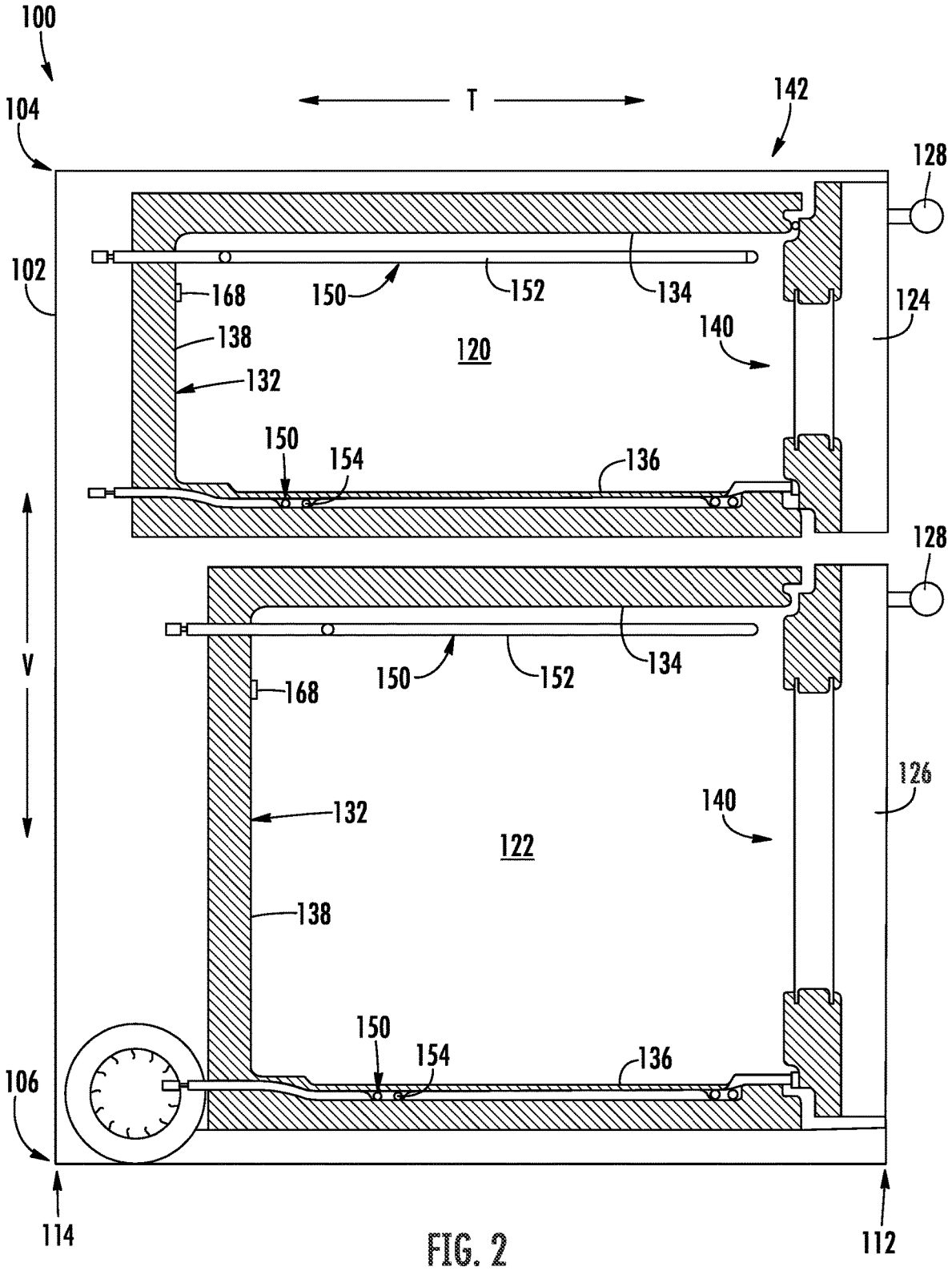
FIG. 2 is a section view of the example oven appliance of FIG. 1 taken along Line 2-2 in FIG. 1.

Referring now specifically to FIG. 2, oven appliance 100 may include various heating elements 150, such as electric resistance heating elements, gas burners, microwave heating elements, halogen heating elements, electric tubular heaters (e.g., such as Calrod® heaters), or suitable combinations thereof. Heating elements 150 are positioned in thermal communication with upper cooking chamber 120 and lower cooking chamber 122 for heating upper cooking chamber 120 and lower cooking chamber 122.

Specifically, an upper heating element 152 (also referred to as a broil heating element, electric burner, or gas burner) may be positioned in cabinet 102, e.g., at a top portion of cooking chambers 120, 122, and a lower heating element 154 (also referred to as a bake heating element, electric burner, or gas burner) may be positioned proximate a bottom portion of cooking chambers 120, 122. Upper heating element 152 and lower heating element 154 may be used independently or simultaneously to heat cooking chambers 120, 122, perform a baking or broil operation, perform a cleaning cycle, etc. The size and heat output of heating elements 152, 154 can be selected based on, e.g., the size of oven appliance 100 or the desired heat output. Oven appliance 100 may include any other suitable number, type, and configuration of heating elements 150 within cabinet 102 and/or on cooktop 142. For example, oven appliance 100 may further include electric heating elements, induction heating elements, or any other suitable heat generating device.

One or more baking racks (not shown) may be positioned in insulated cooking chambers 120, 122 for the receipt of food items or utensils containing food items. The baking racks may be slidably received onto embossed ribs or sliding rails such that the baking racks may be conveniently moved into and out of insulated cooking chamber 120, 122 when doors 124, 126 are open.

A user interface panel 160 is located within convenient reach of a user of the oven appliance 100. For this example embodiment, user interface panel 160 includes knobs 162 that are each associated with one of burners 148. In this manner, knobs 162 allow the user to activate each burner 148 and determine the amount of heat input provided by each burner 148 to cooking food items on cooktop 142. Although shown with knobs 162, it should be understood that knobs 162 and the configuration of oven appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element 150 is activated and/or the rate at which the heating element 150 is set.

Generally, oven appliance 100 may include a controller 166 in operative communication with user interface panel 160. User interface panel 160 of oven appliance 100 may be in communication with controller 166 via, for example, one or more signal lines or shared communication busses, and signals generated in controller 166 operate oven appliance 100 in response to user input via user input devices 162. Input/Output ("I/O") signals may be routed between controller 166 and various operational components of oven appliance 100 such that operation of oven appliance 100 can be regulated by controller 166. In addition, controller 166 may also be in communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chambers 120, 122, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a double oven appliance, it should be appreciated that oven appliance 100 is provided by way of example only. In this regard, the present subject matter is not limited to oven appliances. For example, other oven or range appliances having different configurations, different appearances, and/or different features may also be utilized with the present subject matter as well, e.g., single ovens, electric cooktop ovens, gas cooktops ovens, etc. Moreover, aspects of the present subject matter may be used in any other consumer or commercial appliance where it is desirable to monitor preheating of a cooking chamber, a cooking utensil, etc.

Figure 3:
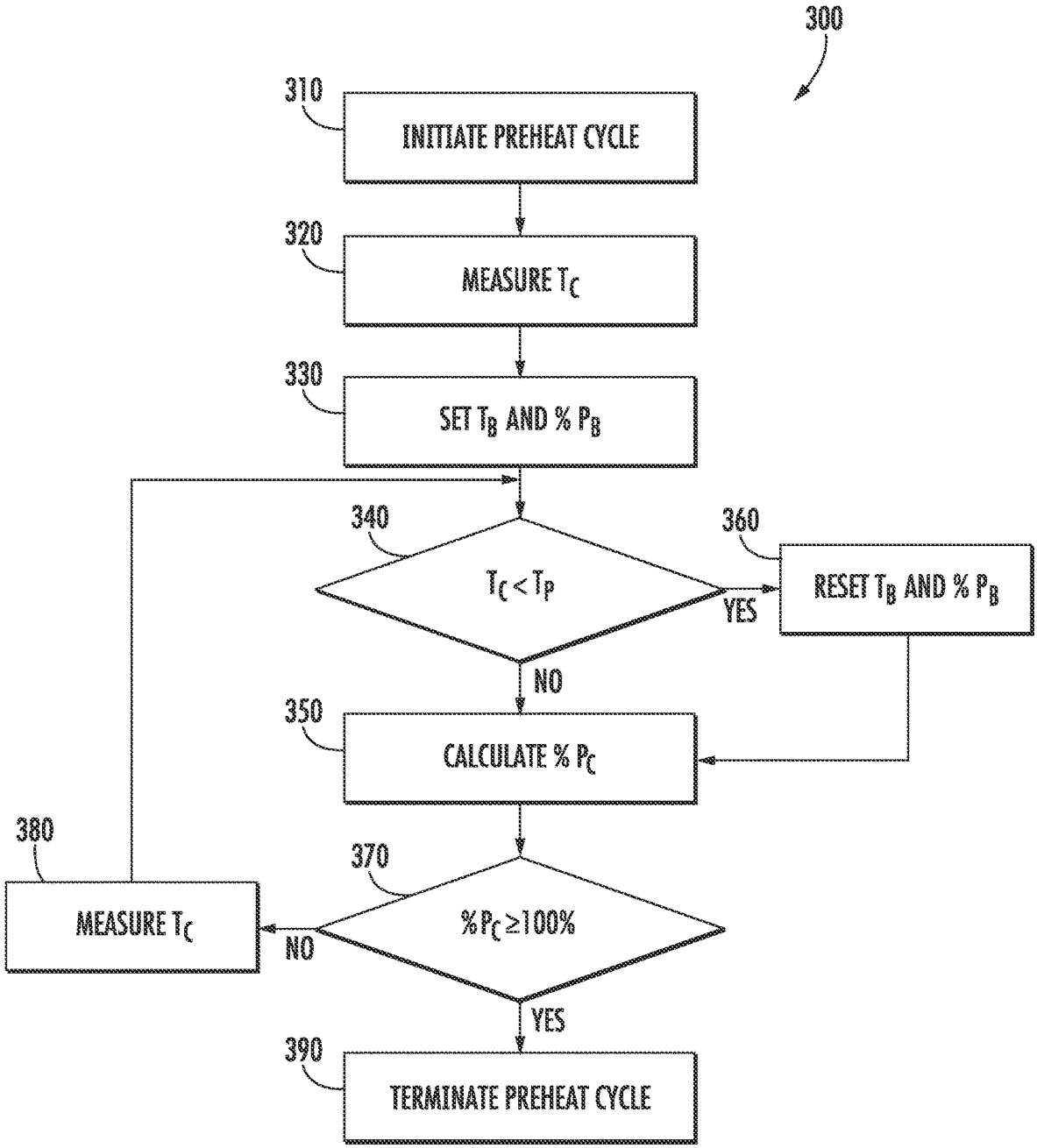
FIG. 3 illustrates a method for monitoring progress of a preheat cycle according to an example embodiment of the present subject matter.

FIG. 3 illustrates a method 300 for monitoring progress of a preheat cycle according to an example embodiment of the present subject matter. As an example, method 300 may be used in or with oven appliance 100 to assist with monitoring a preheat cycle of one of cooking chambers 120, 122 or of a utensil on cooktop 142. The controller 166 of oven appliance 100 may be programmed or configured to implement method 300. While method 300 is described in greater detail below in the context of oven appliance 100, it will be understood that method 300 may be used in or within any suitable appliance in alternative example embodiments.

At 310, a preheat cycle may be initiated. For example, a user may actuate user interface panel 160 in order to activate heating element(s) associated with one or more of upper cooking chamber 120, lower cooking chamber 122, and cooktop 142. For example, controller 166 may activate heating element 150 to heat upper cooking chamber 120 at a start of the preheat cycle. As another example, controller 166 may activate a heating element on cooktop to heat a utensil thereon at a start of the preheat cycle. The user may also select a set temperature at 310. For instance, in response to the user inputting the set temperature at user interface panel 160, controller 166 may initiate the preheat cycle. As another example, the set temperature may be selected based on user entries or menu selections, such as food type (e.g., fried egg, pancake, ground meat, frozen meat balls, biscuits, frozen pizza, casserole, lasagna, cookies, pork chops, etc.) or cooking modes (e.g., melt, simmer, boiling, pan frying, keep warm, keep warm, broil, etc.), and controller 166 may initiate the preheat cycle in response to the selected user entry or menu selection.

At 320, a temperature may be measured by a sensor. For example, controller 166 may receive data from temperature sensor 168 to measure the temperature inside cooking chamber 120. As another example, controller 166 may receive data from a temperature sensor at cooktop 142 to measure the temperature of a utensil or food items therein. The measured temperature at 320 may correspond to the desired set temperature for the preheat cycle. Thus, the sensor may be used to monitor progress of the preheat cycle.

At 330, a baseline temperature measurement and/or a baseline percent progress may be established. For example, controller 166 may initially set the baseline temperature measurement as the temperature measurement from 320 at a start of the preheat cycle. As another example, controller 166 may initially set the baseline percent progress as zero or some other value by which the user can understand that the preheat cycle has started.

At 340, during the preheat cycle, the temperature may continue to be measured by the sensor. For example, controller 166 may periodically or intermittently receive data from the sensor corresponding to a current temperature, e.g., of the cooking chamber 120, the utensil on cooktop 142, or food items within the utensil on cooktop 142. During the preheat cycle, controller 166 may thus receive a plurality of current temperature measurements from the sensor. Each current temperature measurement from the sensor may be compared to an immediate prior temperature measurement from the sensor. Thus, controller 166 may compare the various temperature measurements from the sensor.

At 350, the percent progress of the preheat cycle may be calculated. During the preheat cycle, the current percent progress may be calculated for each current temperature measurement from the sensor. The percent progress of the preheat cycle from a baseline percent progress may be calculated with the following $$\%\ \text{Progress}_C = \%\ \text{Progress}_B + (100\% - \%\ \text{Progress}_B) * \frac{(T_C - T_B)}{(T_S - T_B)},$$

wherein % $\text{Progress}_C$ (labeled % Pc in FIG. 3) is a current percent progress of the preheat cycle, % $\text{Progress}_B$ (labeled % PB in FIG. 3) is the baseline percent progress, $T_c$ is the current temperature measurement, $T_S$ is the set temperature for the preheat cycle, and $T_B$ is the baseline temperature measurement. Each percent progress from 350 may be displayed on user interface panel 160 or some other display for the user, such as a mobile phone.

Method 300 may also include truncating or rounding down the calculated current percent progress of the preheat cycle. Thus, during the preheat cycle, the displayed current percent progress of the preheat cycle may never be higher than the actual calculated current percent progress of the preheat cycle. Such truncating or rounding can advantageously avoid displaying 100% progress prior to actually reaching completion of the preheat cycle. Method 300 may also include clamping or limiting the displayed current percent progress of the preheat cycle. Thus, during the preheat cycle, the displayed current percent progress of the preheat cycle may always be no greater than 100%. Such clamping or limiting can advantageously avoid displaying greater than 100% progress after reaching completion of the preheat cycle.

Figure 5:
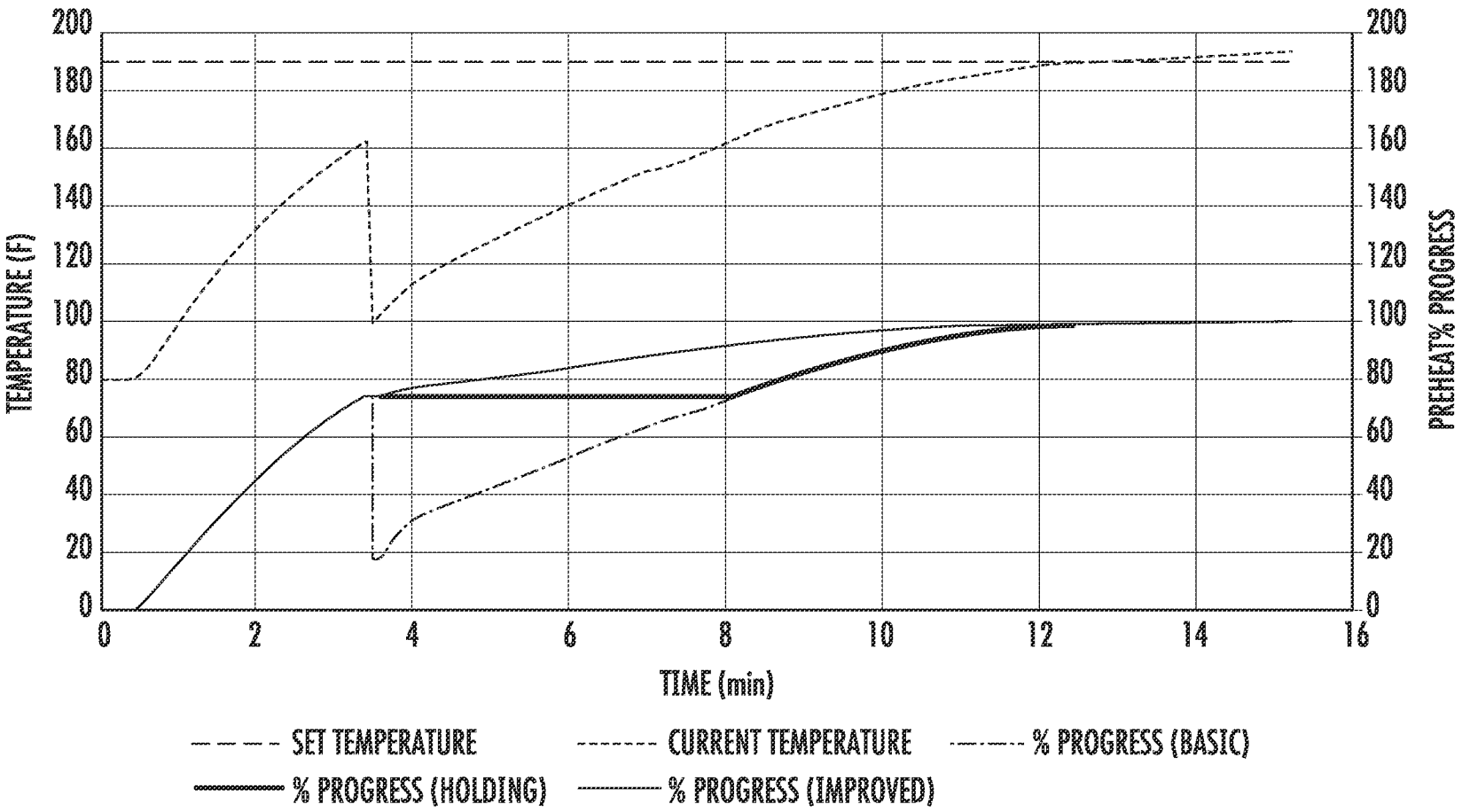
FIG. 5 is a plot of time versus temperature and percent progress utilizing the example method of FIG. 3.

When the current temperature measurement from the sensor (e.g., $T_C$ in the above formula) is greater than or equal to the immediate prior temperature measurement from the sensor, method 300 may continue directly from 340 to 350. As noted above, the baseline temperature measurement may initially be the temperature measurement from 320 at the start of the preheat cycle, and the baseline percent progress may initially be zero. Thus, e.g., as shown in FIG. 5, the percent progress of the preheat cycle (labeled "% Progress (Improved)" in FIG. 5) may start at the baseline percent progress, e.g., zero, and increase as the temperature measurements from the sensor (labeled "Current Temperature" in FIG. 5) increase from the start of the preheat cycle. When the temperature measurements from the sensor indicate that the preheat cycle is increasing the associated temperature, method 300 may utilize current values for the baseline temperature measurement and the baseline percent progress. Conversely, when the temperature measurements from the sensor indicate that the associated temperature is decreasing during the preheat cycle, method 300 may proceed to 360 prior to calculating the percent progress at 350. The temperature measurements from the sensor may decrease, e.g., when a user opens a door, adds liquid or food to a pot, pan, etc.

At 360, the values for the baseline temperature measurement and the baseline percent progress may be reset. For instance, controller 166 may set the baseline temperature measurement (e.g., from the temperature measurement from 320 at the start of the preheat cycle) to the latest temperature measurement from the sensor, and controller 166 may set the baseline percent progress (e.g., from zero) to an immediate prior percent progress. As shown in FIG. 5, by resetting the values for the baseline temperature measurement and the baseline percent progress at 360, the subsequently calculated percent progress at 350 may not decrease and/or may quickly continue to increase once the temperature measurements from the sensor indicate that the preheat cycle is again increasing the associated temperature. In contrast, known displays may disadvantageously show a constant percent progress (labeled "% Progress (Holding)" in FIG. 5) for an extended period of time or may disadvantageously show decreasing percent progresses (labeled "% Progress (Basic)" in FIG. 5).

As may be seen from the above and shown in FIG. 5, method 300 may advantageously allow the percent progress calculated at 350 to never decrease during the preheat cycle. Moreover, a rate of change of the percent progress calculated after resetting the values at 360 may decrease. Thus, method 300 may continue to increase the current percent progress despite the temperature drop, while accounting for the additional time required to complete the preheat cycle, by adjusting the rate of change for the percent progress.

FIG. 3 depicts steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure.

Figure 4:
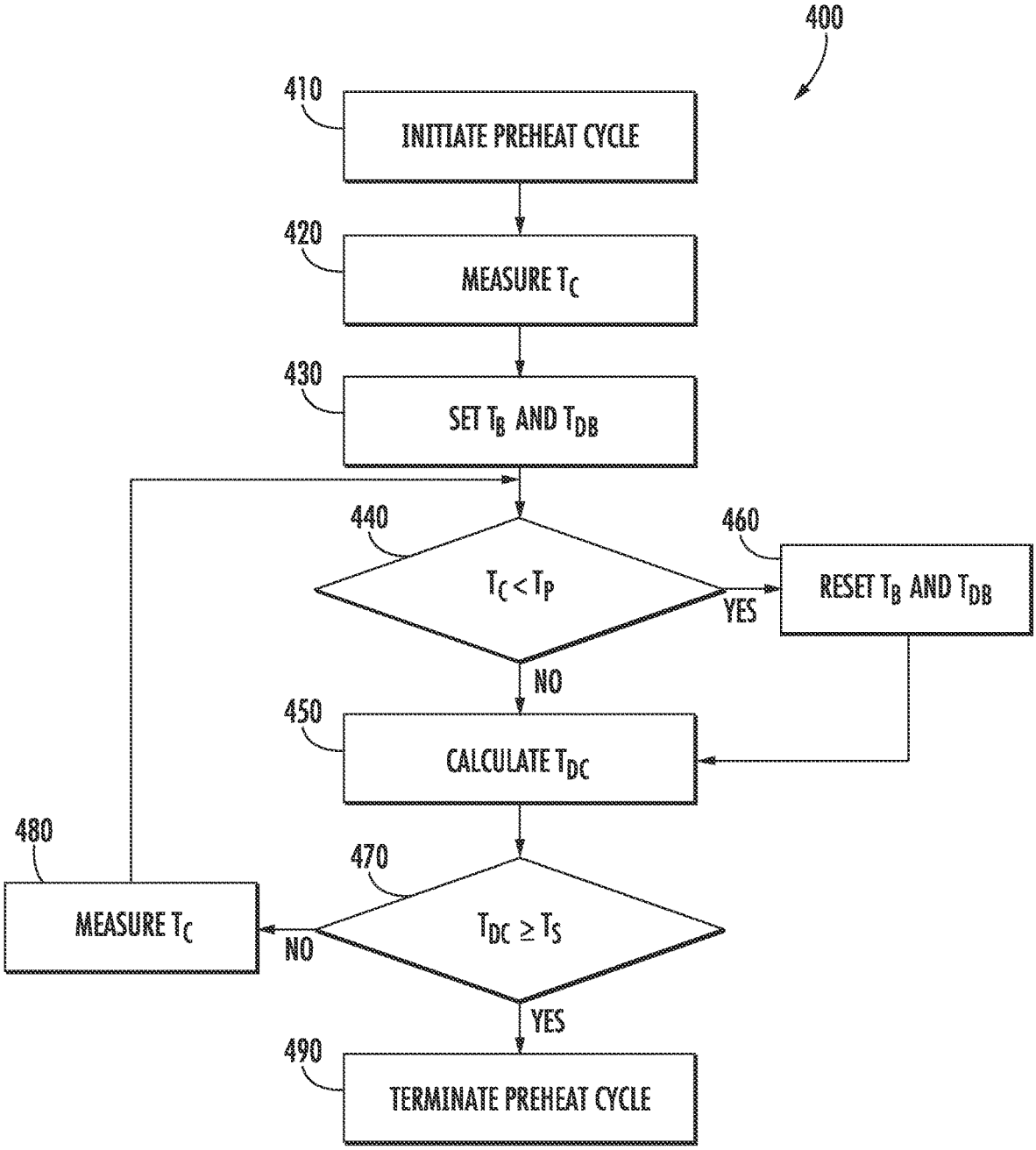
FIG. 4 illustrates a method for monitoring progress of a preheat cycle according to another example embodiment of the present subject matter.

FIG. 4 illustrates a method 400 for monitoring progress of a preheat cycle according to an example embodiment of the present subject matter. As an example, method 400 may be used in or with oven appliance 100 to assist with monitoring a preheat cycle of one of cooking chambers 120, 122 or of a utensil on cooktop 142. The controller 166 of oven appliance 100 may be programmed or configured to implement method 400. While method 400 is described in greater detail below in the context of oven appliance 100, it will be understood that method 400 may be used in or within any suitable appliance in alternative example embodiments.

At 410, a preheat cycle may be initiated. For example, a user may actuate user interface panel 160 in order to activate heating element(s) associated with one or more of upper cooking chamber 120, lower cooking chamber 122, and cooktop 142. For example, controller 166 may activate heating element 150 to heat upper cooking chamber 120 at a start of the preheat cycle. As another example, controller 166 may activate a heating element on cooktop to heat a utensil thereon at a start of the preheat cycle. The user may also select a set temperature at 410. For instance, in response to the user inputting the set temperature at user interface panel 160, controller 166 may initiate the preheat cycle. As another example, the set temperature may be selected based on user entries or menu selections, such as food type (e.g., fried egg, pancake, ground meat, frozen meat balls, biscuits, frozen pizza, casserole, lasagna, cookies, pork chops, etc.) or cooking modes (e.g., melt, simmer, boiling, pan frying, keep warm, keep warm, broil, etc.), and controller 166 may initiate the preheat cycle in response to the selected user entry or menu selection.

At 420, a temperature may be measured by a sensor. For example, controller 166 may receive data from temperature sensor 168 to measure the temperature inside cooking chamber 120. As another example, controller 166 may receive data from a temperature sensor at cooktop 142 to measure the temperature of a utensil or food items therein. The measured temperature at 420 may correspond to the desired set temperature for the preheat cycle. Thus, the sensor may be used to monitor progress of the preheat cycle.

At 430, a baseline temperature measurement (labeled $T_B$ in FIG. 4) and/or a baseline display temperature (labeled $T_{DB}$ in FIG. 4) may be established. For example, controller 166 may initially set the baseline temperature measurement as the temperature measurement from 420 at a start of the preheat cycle. As another example, controller 166 may initially set the baseline display temperature as the temperature measurement from 420 at the start of the preheat cycle or some other value by which the user can understand that the preheat cycle has started.

At 440, during the preheat cycle, the temperature may continue to be measured by the sensor. For example, controller 166 may periodically or intermittently receive data from the sensor corresponding to a current temperature, e.g., of the cooking chamber 120, the utensil on cooktop 142, or food items within the utensil on cooktop 142. During the preheat cycle, controller 166 may thus receive a plurality of current temperature measurements from the sensor. Each current temperature measurement from the sensor may be compared to an immediate prior temperature measurement from the sensor. Thus, controller 166 may compare the various temperature measurements from the sensor.

At 450, the display temperature of the preheat cycle may be calculated. During the preheat cycle, the current display temperature may be calculated for each current temperature measurement from the sensor. The display temperature of the preheat cycle from a baseline display temperature may be calculated with the following $$T_{DC} = T_{DB} + (T_S - T_{DB}) * \frac{(T_C - T_B)}{(T_S - T_B)},$$

wherein $T_{DC}$ is a current display temperature of the preheat cycle, $T_{DB}$ is the baseline display temperature, $T_C$ is the current temperature measurement, $T_S$ is the set temperature for the preheat cycle, and $T_B$ is the baseline temperature measurement. Each display temperature from 450 may be displayed on user interface panel 160 or some other display for the user, such as a mobile phone.

Method 400 may also include truncating or rounding down the current calculated temperature for the preheat cycle. Thus, during the preheat cycle, the displayed temperature for the preheat cycle may never be higher than the actual calculated display temperature for the preheat cycle. Such truncating or rounding can advantageously avoid displaying the set temperature prior to actually reaching completion of the preheat cycle. Method 400 may also include clamping or limiting the displayed temperature for the preheat cycle. Thus, during the preheat cycle, the displayed temperature for the preheat cycle may always be no greater than the set temperature. Such clamping or limiting can advantageously avoid displaying temperatures greater than the set temperature after reaching completion of the preheat cycle.

When the current temperature measurement from the sensor is greater than or equal to the immediate prior temperature measurement from the sensor, method 400 may continue directly from 440 to 450. As noted above, the baseline temperature measurement may initially be the temperature measurement from 420 at the start of the preheat cycle, and the baseline display temperature may initially be the temperature measurement from 420 at the start of the preheat cycle or some default value. When the temperature measurements from the sensor indicate that the preheat cycle is increasing the associated temperature, method 400 may utilize current values for the baseline temperature measurement and the baseline display temperature. Conversely, when the temperature measurements from the sensor indicate that the associated temperature is decreasing during the preheat cycle, method 400 may proceed to 460 prior to calculating the display temperature at 450. The temperature measurements from the sensor may decrease, e.g., when a user opens a door, adds liquid or food to a pot, pan, etc.

At 460, the values for the baseline temperature measurement and the baseline display temperature may be reset. For instance, controller 166 may set the baseline temperature measurement (e.g., from the temperature measurement from 420 at the start of the preheat cycle) to the current or latest temperature measurement from the sensor, and controller 166 may set the baseline display temperature (e.g., from the initial or default value) to an immediate prior display temperature. By resetting the values for the baseline temperature measurement and the baseline display temperature at 460, the subsequently calculated display temperature at 450 may not decrease and/or may quickly continue to increase once the temperature measurements from the sensor indicate that the preheat cycle is again increasing the associated temperature.

Figure 6:
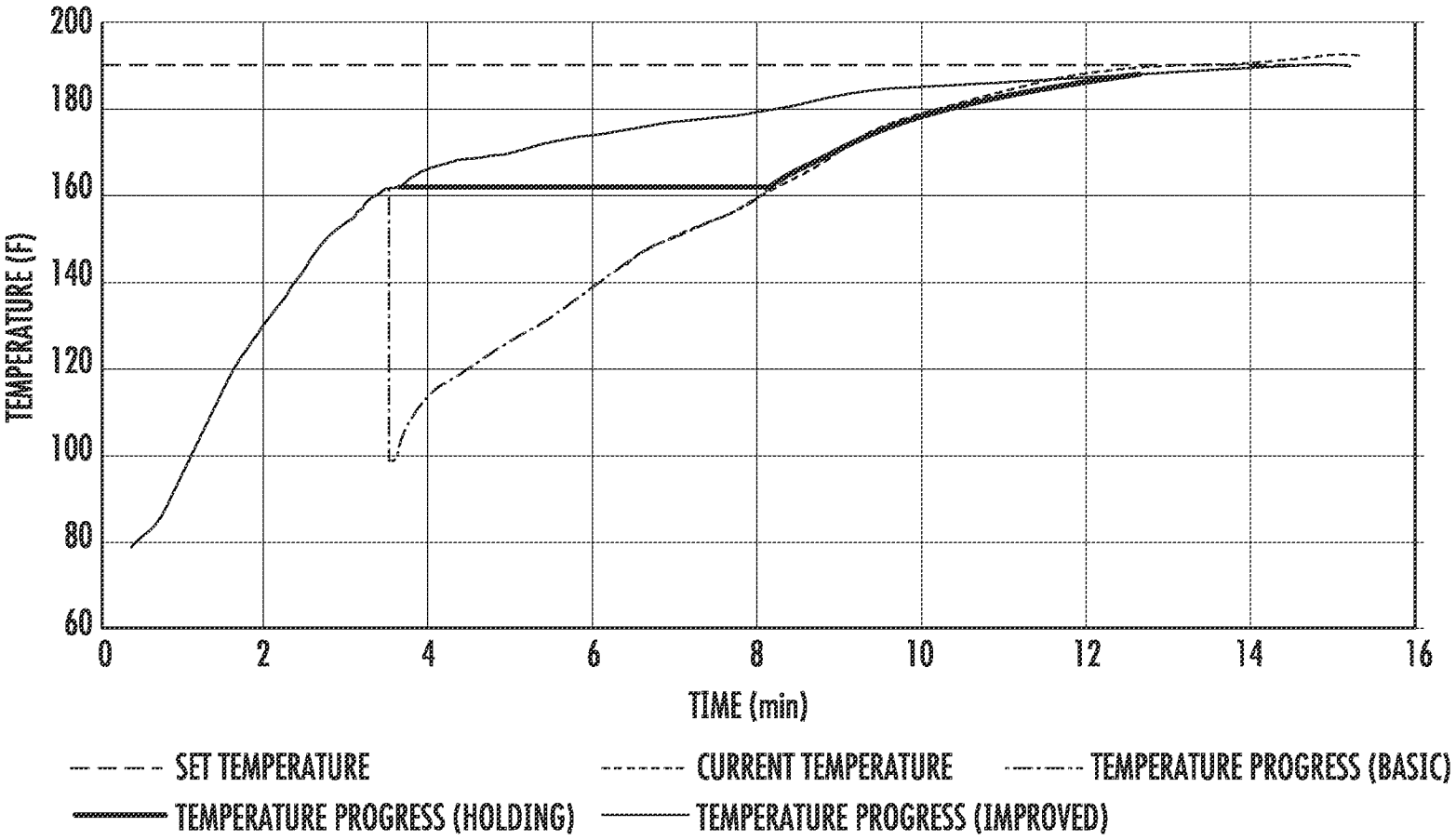
FIG. 6 is a plot of time versus temperature and displayed temperature utilizing the example method of FIG. 4.

As shown in FIG. 6, by resetting the values for the baseline temperature measurement and the baseline display temperature at 460, the subsequently calculated display temperature at 450 (labeled "Temperature Progress (Improved)" in FIG. 6) may not decrease and/or may quickly continue to increase once the temperature measurements from the sensor indicate that the preheat cycle is again increasing the associated temperature. In contrast, known displays may disadvantageously show a constant display temperature (labeled "Temperature Progress (Holding)" in FIG. 6) for an extended period of time or may disadvantageously show decreasing display temperature (labeled "Temperature Progress (Basic)" in FIG. 6).

As may be seen from the above and in a similar manner to that shown in FIG. 5 with reference to method 300 (FIG. 3), method 400 may advantageously allow the display temperature calculated at 450 to never decrease during the preheat cycle. Moreover, a rate of change of the display temperature calculated after resetting the values at 460 may decrease. Thus, method 400 may continue to increase the current display temperature despite the temperature drop, while accounting for the additional time required to complete the preheat cycle, by adjusting the rate of change for the display temperature.

FIG. 4 depicts steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure.

In certain example embodiments, methods 300, 400 may be combined. For instance, both the current percent progress may be calculated using method 300 and the current display temperature may be calculated using method 400, and a user may select whether the current percent progress or the current display temperature is presented on a display. As another example, the current display temperature may be calculated from the current percent progress (e.g., calculated at 350) with the following $$T_{DC} = T_I + \left(\frac{\%\ \text{Progress}_C}{100}\right) * (T_S - T_I)$$

wherein $T_I$ is the initial temperature or temperature measurement from 320 or 420 at the start of the preheat cycle. $T_I$ may be a fixed value and never be reset. As may be seen from the above, e.g., the current display temperature may be indirectly calculated using the current percent progress or vice versa.

The present subject matter may advantageously assist cooking appliances, such as ranges, ovens, cooktops, etc., to allow user to monitor preheating to a set temperature for a cooking cycle, such as bake, broil, or a closed-loop cooking cycle on a cooktop. Method may prevent progress pullbacks and/or minimize progress stalls.

The sampling rate for the sensor may be any suitable value, e.g., one hundred milliseconds, five seconds, etc. A resolution of the displayed progress indicator value (e.g., temperature, percentage, etc.) may be any suitable value, e.g., five percent, ten degrees, etc. Moreover, the progress indicator value may be other suitable progress indicator values, such as remaining preheat percent progress, temperature error progress, estimated remaining preheat time, accumulated preheat time, etc. The calculated progress indicator value could also be presented to the user indirectly, e.g., via a progress bar, changing ambient light color, distinct sounds, voice, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for monitoring progress of a preheat cycle, comprising:

at a start of a preheat cycle, receiving a baseline temperature measurement from a sensor;

during the preheat cycle, receiving a plurality of current temperature measurements from the sensor;

repeatedly calculating, at a controller, a progress indicator value for the preheat cycle from a baseline progress indicator value based at least in part on a difference between a latest one of the plurality of current temperature measurements and the baseline temperature measurement and a difference between a set temperature for the preheat cycle and the baseline temperature measurement; and when the latest one of the plurality of current temperature measurements is less than an immediate prior one of the plurality of current temperature measurements, setting the baseline temperature measurement to the latest one of the plurality of current temperature measurements and setting the baseline progress indicator value to an immediate prior progress indicator value, wherein a rate of change of the progress indicator value over time decreases after setting the baseline temperature measurement to the latest one of the plurality of current temperature measurements and setting the baseline progress indicator value to the immediate prior progress indicator value.

2. The method of claim 1, wherein the set temperature is a user selected set temperature or is predetermined based upon a user selection.

3. The method of claim 1, wherein the progress indicator value of the preheat cycle never decreases during the preheat cycle.

4. The method of claim 1, wherein the progress indicator value is either a percentage or a temperature.

5. A method for monitoring progress of a preheat cycle, comprising:

at a start of a preheat cycle, receiving a baseline temperature measurement from a sensor;

during the preheat cycle, receiving a plurality of current temperature measurements from the sensor;

repeatedly calculating, at a controller, a percent progress of the preheat cycle from a baseline percent progress with the following $$\%\ \text{Progress}_C = \%\ \text{Progress}_B + (100\% - \%\ \text{Progress}_B) * \frac{(T_C - T_B)}{(T_S - T_B)},$$

wherein

% $\text{Progress}_C$ is a current percent progress of the preheat cycle,

% $\text{Progress}_B$ is the baseline percent progress, $T_C$ is the current temperature measurement, $T_S$ is a set temperature for the preheat cycle, and $T_B$ is the baseline temperature measurement; and when a latest one of the plurality of current temperature measurements is less than an immediate prior one of the plurality of current temperature measurements, setting the baseline temperature measurement to the latest one of the plurality of current temperature measurements and setting the baseline percent progress to an immediate prior percent progress.

6. The method of claim 5, wherein the set temperature is a user selected set temperature or is predetermined based upon a user selection.

7. The method of claim 5, wherein the percent progress of the preheat cycle never decreases during the preheat cycle.

8. The method of claim 5, wherein a rate of change of the percent progress over time decreases after setting the baseline temperature measurement to the latest one of the plurality of current temperature measurements and setting the baseline percent progress to the immediate prior percent progress.

9. A method for monitoring progress of a preheat cycle, comprising: at a start of a preheat cycle, receiving a baseline temperature measurement from a sensor;

during the preheat cycle, receiving a plurality of current temperature measurements from the sensor;

repeatedly calculating, at a controller, a display temperature for the preheat cycle from a baseline display temperature with the following $$T_{DC} = T_{DB} + (T_S - T_{DB}) * \frac{(T_C - T_B)}{(T_S - T_B)},$$

wherein $T_{DC}$ is a current display temperature for the preheat cycle, $T_{DB}$ is the baseline display temperature for the preheat cycle, $T_S$ is a set temperature for the preheat cycle, $T_C$ is the current temperature measurement, and $T_B$ is the baseline temperature measurement; and when a latest one of the plurality of current temperature measurements is less than an immediate prior one of the plurality of current temperature measurements, setting the baseline temperature measurement to the latest one of the plurality of current temperature measurements and setting the baseline display temperature to an immediate prior display temperature.

10. The method of claim 9, wherein the set temperature is a user selected set temperature or is predetermined based upon a user selection.

11. The method of claim 9, wherein the display temperature for the preheat cycle never decreases during the preheat cycle.

12. The method of claim 9, wherein a rate of change of the display temperature over time decreases after setting the baseline temperature measurement to the latest one of the plurality of current temperature measurements and setting the baseline display temperature to the immediate prior display temperature.

* * * * *